United States Patent [19]

Harris

[11] Patent Number: 4,470,216

[45] Date of Patent: Sep. 11, 1984

[54] BIPOD MOUNTING DEVICE AND MUZZLE BRAKE

[76] Inventor: Gerald Harris, Barlow, Ky. 42024

[21] Appl. No.: 367,544

[22] Filed: Apr. 12, 1982

[51] Int. Cl.[3] ..... F41C 29/00

[52] U.S. Cl. ..... 42/85; 42/94

[58] Field of Search ..... 42/71 R, 72, 85, 86, 42/94; 89/37 BA, 40 E

[56] References Cited

U.S. PATENT DOCUMENTS

| | | | |
|---|---|---|---|
| 1,372,599 | 3/1921 | Butler | 89/40 E |
| 1,746,364 | 2/1930 | Schuler | 89/40 E |
| 1,890,423 | 12/1932 | Teagarden | 42/94 |
| 2,375,721 | 5/1941 | Woodhull | 89/37 B |
| 3,327,422 | 6/1967 | Harris | 49/94 |

*Primary Examiner*—Stephen C. Bentley

*Attorney, Agent, or Firm*—Harness, Dickey & Pierce

[57] ABSTRACT

An attachment or mounting apparatus is disclosed for securing a bipod or other auxiliary device to a variety of different types of firearms. In the preferred embodiment, the attachment or mounting apparatus incorporates a muzzle brake device therein. Various embodiments are disclosed wherein the longitudinal location, and the angle of attachment, of said bipod with respect to the firearm may be selectively adjusted by the user.

9 Claims, 12 Drawing Figures

BIPOD MOUNTING DEVICE AND MUZZLE BRAKE

BACKGROUND AND SUMMARY OF THE INVENTION

The present invention relates to a bipod mounting device adapted for attachment to a firearm. More particularly, the preferred embodiment of the invention relates to such a bipod mounting device having a muzzle brake apparatus incorporated therein.

Modern firearms, such as rifles in particular, may be more accurately and conveniently fired by the user if the firearm is equipped with a bipod device for supporting the barrel. One example of a lightweight, detachable bipod device with foldable legs is described in my previous patent, U.S. Pat. No. 3,327,422, issued on June 27, 1967, the disclosure of which is incorporated by reference herein.

Said previous patent discloses a bipod device which is removably attached to the forearm portion of the stock of a firearm. Such attachment is preferably accomplished by means of a pair of link members having fingers or pins protruding therefrom which are received within an aperture extending laterally in a stud or other fastener member secured to the stock of the firearm. The stock of many firearms are provided with such apertured studs which are normally supporting a loop-shaped swivel member adapted to receive one end of a sling. The bipod device is secured against the forearm of the firearm by a threaded abutment screw which is extended to urge the base of the bipod device securely against the forearm of the firearm. While such bipod device of my earlier patent is well adapted for convenient use with many firearms whose stocks are equipped with the above-described stud or fastener member, other firearms frequently require modifications to provide the necessary stud or equivalent member having a head with an aperture therethrough for receiving the pins of the link members of the bipod device.

In accordance with the present invention, an alternative attachment or mounting apparatus is provided for securing a bipod device, such as that described in my earlier patent, to a variety of firearms which may not include an apertured stud or other fastener member such as that described above. In the preferred embodiment of the present invention, the attachment or mounting apparatus also incorporates a muzzle brake device therein. Such a muzzle brake device is a desirable addition to the barrel of a firearm for purposes of reducing recoil, muzzle jump and muzzle blast. Other alternate embodiments, both with and without muzzle brakes, are disclosed for adapting such a bipod device to a wide variety of firearms.

BRIEF DESCRIPTION OF THE DRAWINGS

FIG. 8 is an alternate embodiment of still another attachment or mounting apparatus for attaching a bipod device to the stock of a firearm.

DETAILED DESCRIPTION OF THE PREFERRED EMBODIMENTS

Figure 1:
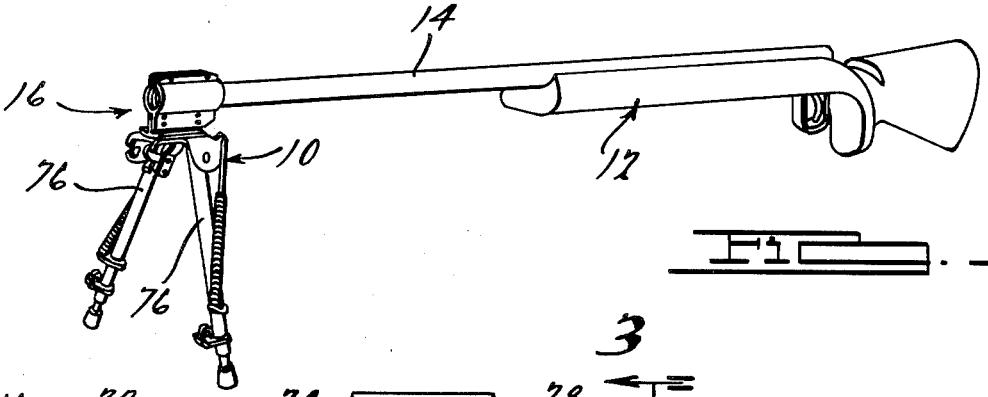
FIG. 1 is an overall perspective view of a rifle having a preferred embodiment of the bipod device and muzzle brake apparatus according to the present invention mounted thereon.

For purposes of illustration, various embodiments of the present invention are shown in the drawings as attached or mounted to a rifle. One skilled in the art will readily recognize, however, that various embodiments of the present invention are applicable to other types of firearms as well.

FIG. 1 generally illustrates a bipod device 10, similar to that described in the above-mentioned U.S. Pat. No. 3,327,422, mounted on a typical rifle 12. The bipod device 10 is secured to the barrel 14 of the rifle 12 by means of a preferred bipod mounting assembly 16, which includes a muzzle brake portion 18 therein. It should be noted that the mounting assemblies and apparatus shown in the drawings may be also employed for purposes of mounting or attaching auxiliary devices other than the bipod device 10.

Figure 2:
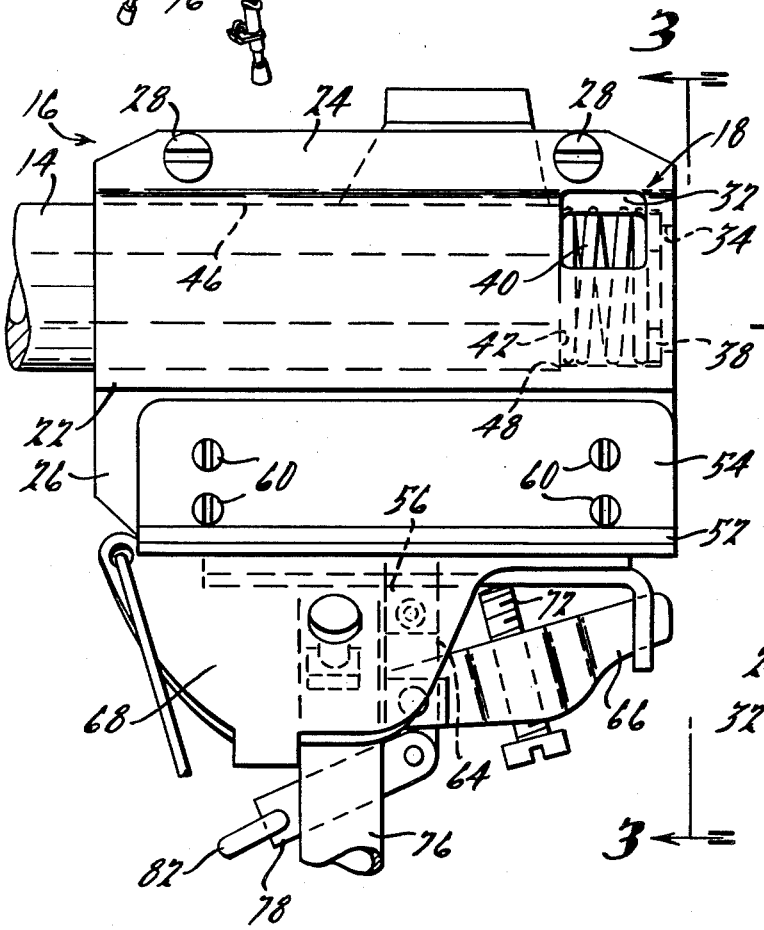
FIG. 2 is an enlarged detail view of the attachment or mounting assembly and muzzle brake apparatus of the preferred embodiment shown in FIG. 1.
Figure 3:
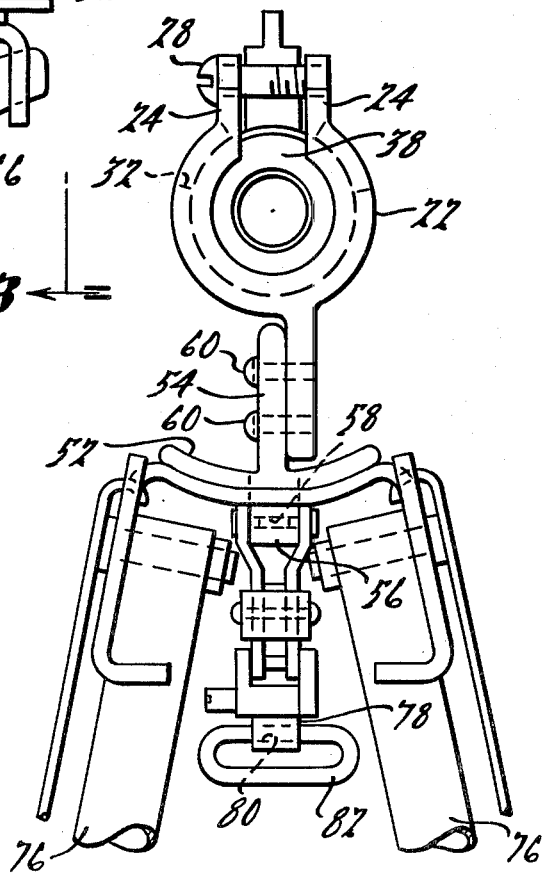
FIG. 3 is an end view taken along line 3—3 of FIG. 2.

As is best illustrated in FIGS. 2 and 3, the preferred bipod mounting assembly 16 includes a sleeve portion 22 with a pair of spaced upper flange members 24 protruding therefrom in a generally upward direction and a lower flange member downwardly depending therefrom. The sleeve portion 22 is split between the upper flange members 24 and is secured in a tight, clamping engagement or relationship with the periphery of the barrel 14 by one or more threaded fasteners 28 extending through corresponding apertures in the upper flange members 24.

As is mentioned above, the sleeve portion 22 of the preferred bipod mounting assembly 16 also includes a muzzle brake portion 18 therein. The muzzle brake portion 18 of the sleeve portion 22 preferably includes a pair of gas vent openings 32 extending generally in a radial direction therethrough. As is shown in FIG. 2, the muzzle brake portion 18 of the sleeve portion 22 extends longitudinally beyond the forward end 42 of the rifle barrel 14 and preferably includes an annular lip 34 at its outer end. A baffle ring 38 is biased in a generally outward direction in abutting engagement with the annular lip 34 by the force of a biasing spring 40 compressed between the baffle ring 38 and the forward end 42 of the rifle barrel 14. To ensure that the forward end 42 is properly spaced from the baffel ring 38 and that the proper biasing force is exerted upon the baffle ring 38 by the biasing spring 40, the inner bore 46 of the sleeve portion 22 is provided with a step 48 which abuttingly engages the outward end 42 of the rifle barrel 14.

The muzzle brake portion 18 of the preferred bipod mounting assembly 16 serves to lessen the effects of recoil, muzzle jump and muzzle blast upon firing a projectile from the rifle 12 by providing both the gas vent openings 32 and the baffle ring 38 against which the exhaust gases resulting from the firing of a cartridge can flow and impinge, respectively. As the gases escape from the end of the barrel 14, they exert a generally forward directed force on the baffle ring 38 and also flow in a generally upward or outward direction through the gas vent openings 32 to exert a force in a generally downward direction, thereby opposing and mitigating the recoil and muzzle jump forces. The baffle ring 38 is preferably composed of a relatively soft material, such as aluminum or brass for example, in order to prevent or minimize the damage in the event that an errant projectile contacts the baffle ring 38.

The preferred bipod mounting assembly 16 also includes a base portion or bipod mounting bracket 52 with an upwardly extending mounting flange or plate 54 and a downwardly extending mounting lug 56 thereon. A number of preferably threaded fasteners extend through a corresponding number of apertures in the mounting flange or plate 54 and serve to secure the mounting flange or plate 54 to the lower flange member 26 of the sleeve portion 22. Although not illustrated as such in the drawings, one or more of the apertures in the mounting flange or plate 54 may be in the form of an arcuate or kidney-shaped slot. Such a slot would allow the angle of attachment of the bipod mounting bracket 52 and thus the bipod device 10 to be adjusted merely by loosening the appropriate fasteners 60 and retightening them after adjusting the angle of the base portion or bipod mounting bracket 52 as desired. The mounting flange or plate 54 also includes an aperture 58 extending in a generally horizontal or lateral direction through the mounting lug 56 for receiving the fingers or pins 62 on the link members 64 of the bipod device 10.

As is described in my above-referenced previous patent, the link members 64 of the bipod device 10 are hingedly attached to a pivot member 66 which is pivotally mounted on a base member or platform 68 of the bipod device 10. An abutment screw 72 extends through a threaded aperture in the pivot member 66 to abuttingly engage the lower surface of the base member or platform 68. As the abutment screw 72 is threadably extended, the link members 64 and the mounting lug 56 are drawn or forcibly urged downwardly such that the bipod mounting bracket 52 of the bipod mounting assembly 16 is drawn into a tight abutting or clamping engagement with the base member or platform 68 to prepare the bipod device 10 for use. The legs 76 of the bipod device 10 may then be rotated to their lowered position, such as is shown in FIG. 1, to serve as a support mechanism for the barrel portion of the rifle 12.

The bipod mounting assembly also preferably includes a pivotally attached sling mounting lug 78 having an aperture 80 extending in a generally horizontal direction therethrough for receiving a loop-type sling swivel member 82. Such swivel member 82 allows a sling to be attached to the rifle 12 at roughly the same longitudinal location as the bipod device 10, thereby virtually eliminating any cumbersome interference between the folded legs of the bipod device and other paraphenalia when the rifle 12 is being carried by the user.

Figure 4:
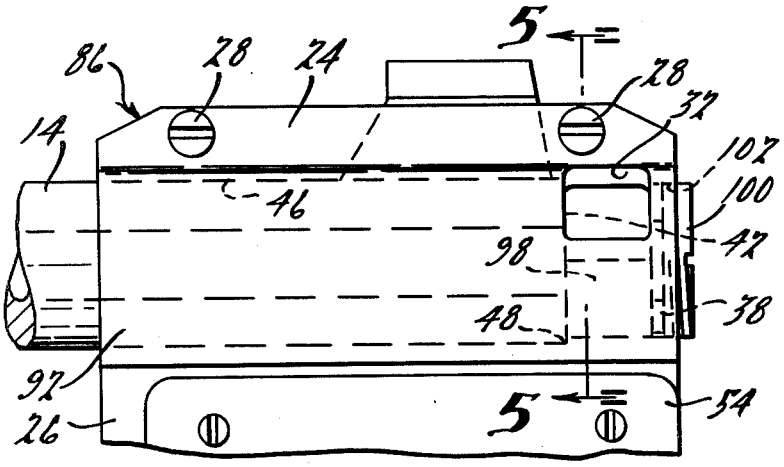
FIG. 4 is an elevation view of a bipod attachment or mounting apparatus similar to that of FIG. 2, but with an alternate muzzle brake apparatus included therein.
Figure 5:
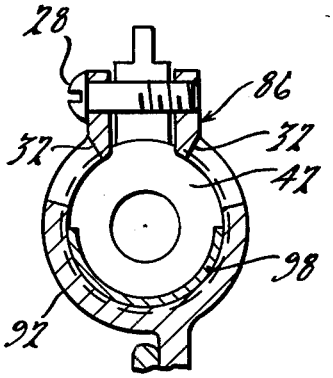
FIG. 5 is a cross-sectional view taken along line 5—5 of FIG. 4.

FIGS. 4 and 5 illustrate an alternate embodiment of the present invention wherein a bipod mounting assembly 86 preferably includes an alternate muzzle brake portion 88 thereon. The bipod mounting assembly 86 is similar to the above-described preferred bipod mounting assembly 16 in virtually all respects except for the configuration of the alternate muzzle brake portion 88.

The bipod mounting assembly 86 includes a sleeve portion 92 having an inner bore 96 extending longitudinally, and gas vent openings 32 extending radially, therethrough. A spacer member 98, which is preferably of a half-cylinder shape, is disposed within the lower half of the outer end of the inner bore 96 and serves to maintain a predetermined spacing between the outer end 42 of the rifle barrel 14 and the baffle ring 38 and to bias the baffle ring 38 against an externally threadable retainer ring 100. The baffle ring 38 is held in place at the outer end of the inner bore 96 by the externally threaded retainer ring 100 which threadably engages an internally threaded end portion 102 of the inner bore 96. As with the inner bore 46 of the preferred bipod mounting assembly 16, the inner bore 96 of the alternate bipod mounting assembly 86 includes a step 48 thereon for purposes of positioning the outward end 42 of the rifle barrel 14 at the proper longitudinal location with respect to the outer end of the sleeve portion 92.

It should be noted that the above-described annular lip 34 may alternatively be employed to retain the baffle ring 38 in place in the alternate muzzle brake portion 88 described herein. Similarly, the externally threaded retainer ring 100 shown in FIGS. 4 and 5 may alternatively be employed in the preferred muzzle brake porton 18 described above.

The alternate muzzle brake portion 88 of the bipod mounting assembly 86 functions in a manner similar to that of the muzzle brake portion 18 of the preferred bipod mounting assembly 16. As a cartridge is fired in the rifle 12, the exhaust gases exiting from the outward end 42 of the rifle barrel 14 impinge upon the baffle ring 38 and flow through the gas vent openings 32, thereby imposing forces thereon in generally forward and downward directions which tend to oppose and mitigate the effects of recoil and other forces. The baffle ring 38 in the alternate bipod mounting assembly 86 is also composed of a soft material, such as aluminum or brass for example, as is described above in connection with the preferred bipod assembly 16.

Figure 6:
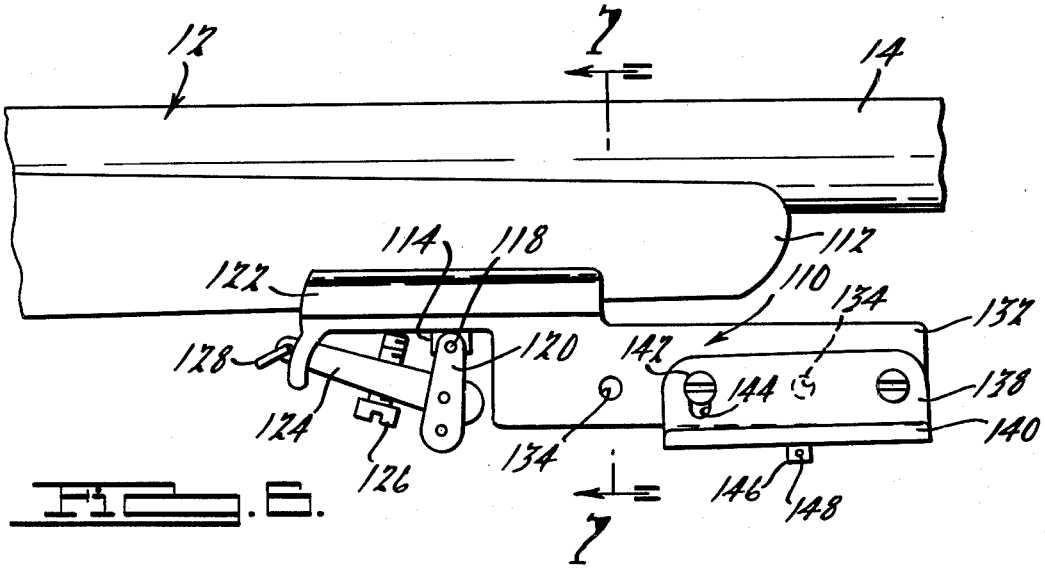
FIG. 6 is an elevation view of an alternate attachment or mounting apparatus for attaching a bipod device to the stock of a firearm, including means for selectively varying the longitudinal location and mounting angle of said bipod device.
Figure 7:
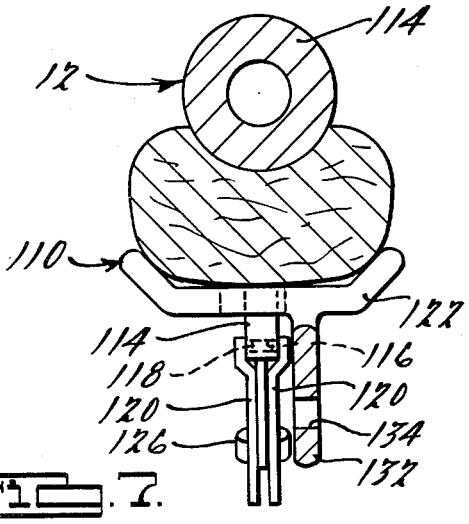
FIG. 7 is a cross-sectional view taken along line 7—7 of FIG. 6.

FIGS. 6 and 7 illustrate still another alternate embodiment of the invention, including a mounting bracket assembly 110 secured to the stock 112 of the rifle 12. The mounting bracket assembly 110, shown for purposes of illustration in FIG. 10, does not include a muzzle brake device therein. One skilled in the art, however, will readily recognize that many of the principles of the embodiment of FIGS. 6 and 7 are equally applicable to barrel-mounted attachment devices with muzzle brakes incorporated therein such as those shown in the other embodiments described herein. Secured to the stock 112 of the rifle 12 is a stud or other fastener member 114 with an aperture 116 extending in a generally horizontal or lateral direction therethrough. The aperture 116 is adapted for receiving a pair of fingers or pins 118 on the link members 120 of the mounting bracket assembly 110. Similar to the bipod device 10, described above and in my above-referenced previous patent, the mounting bracket assembly 110 includes a base member or platform 122 and a pivot member 124 which is hingedly attached to the link members 120. An abutment screw 126 extends through a threaded aperture in the pivot member 124 to abuttingly engage the lower surface of the base member or platform 122. As the abutment screw 126 is threadably extended, the link members 120 and the stud or other fastener member 114 are drawn or forcibly urged downwardly such that the base member or platform 122 is drawn into a tight abutting or clamping engagement with the stock 112. Preferably, the pivot member 124 includes a loop-type sling swivel member 128 for receiving a sling in a manner similar to that described above.

The mounting bracket assembly 110 also includes a mounting flange 132 extending in a downward and forward direction. It should be noted, however, that although the mounting bracket assembly 110 is oriented in FIGS. 6 and 7 with its mounting flange 132 extending in a forward direction, the mounting bracket assembly 110 may also be mounted to the stock 112 in a reverse configuration wherein the mounting flange 132 protrudes in a rearward longitudinal direction if desired.

The mounting flange 132 of the mounting bracket assembly 110 includes a plurality of mounting apertures 134 extending horizontally or laterally therethrough. Such mounting apertures 134 allow a base portion or bipod mounting bracket 140 with a mounting flange or plate 138 thereon to be secured to the mounting flange 132 by means of an appropriate number of fasteners 142 extending through a corresponding number of apertures in the mounting flange or plate 138. Preferably, one or more of the apertures in the mounting flange or plate 138 are in the form of an arcuate or kidney-shaped slot 144. The arcuate slot 144 allows the angle of attachment of the bipod mounting bracket 140 and thus the bipid device 10 (shown above) to be adjusted in a manner similar to that described above in connection with the preferred and alternate bipod mounting assemblies 16 and 86, respectively.

The bipod mounting bracket 140 also includes a mounting lug 146 extending dowwardly therefrom and having an aperture 148 extending horizontally or laterally therethrough. The aperture 148 is adapted to receive the fingers or pins 62 on the link members 64 of the bipod device 10 as is fully described above.

The above-described mounting bracket assembly 110 offers the user a great amount of flexibility in that the longitudinal position of the bipod device 10 may be varied widely as desired. The bipod mounting bracket 140 may be secured to the mounting flange 132 at any combination of the mounting apertures 134 thereon. Furthermore, as is mentioned above, the mounting bracket assembly 110 may be attached to the stock 112 of the rifle 12 with its mounting flange 132 protruding in either a forward or rearward direction as desired. Finally, as is also mentioned above, the angle of attachment of the bipod device 10 may be adjusted as desired by the user by means of the arcuate slot 144 on the bipod mounting bracket 140.

Figure 9:
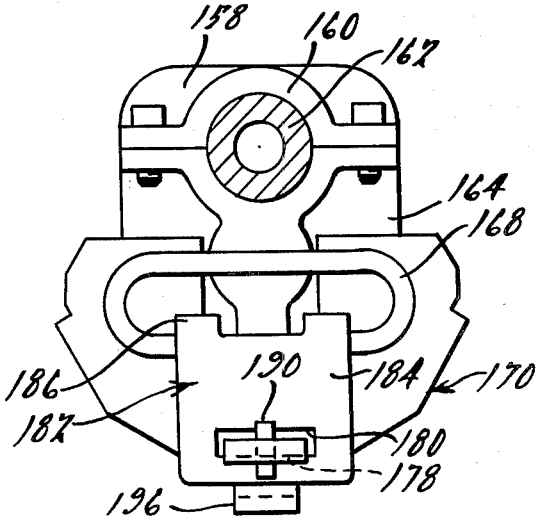
FIG. 9 is a cross-sectional view taken along line 9—9 of FIG. 8.
Figure 9:
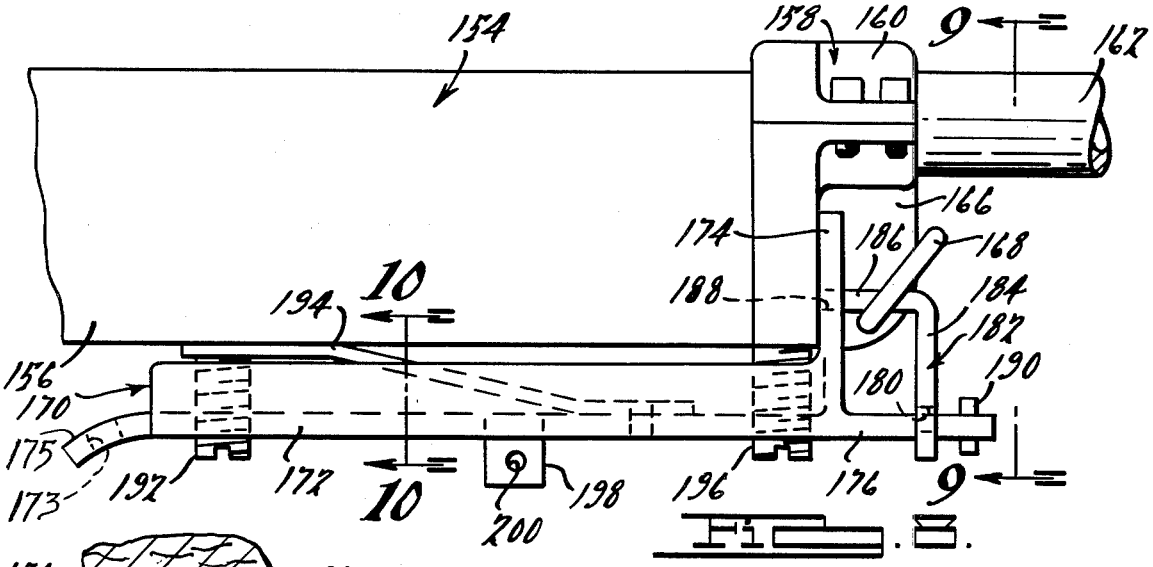
Figure 10:
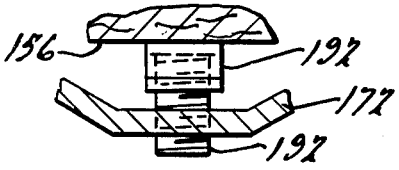
FIG. 10 is a cross-sectional view taken along line 10—10 of FIG. 8.

Still another embodiment of the present invention is illustrated in FIGS. 8 through 10 whereby the bipod device 10 of my previous patent may be attached to a firearm or rifle 154 which has no apertured stud or other fastener member secured to its stock 156. The embodiment illustrated in FIGS. 8 through 10 is especially well suited to provide a mounting means for the bipod device 10 where such an apertured stud or other fastener member may not be secured to the stock 156 or where the user deems that it is undesirable to do so.

Many firearms or rifles are provided with a stock assembly that includes a stock mounting bracket, such as that indicated by reference number 158 having a clamshell or split sleeve portion 160 for attaching the stock 156 to the barrel 162. Such a stock mounting bracket 158 also generally includes a flange portion 164 which engages the perphery and end portion of the stock 156. The stock mounting bracket 158 also includes a forward portion 166 with a sling swivel 168 pivotally attached thereto. Alternatively, if the stock assembly does not include a stock mounting bracket similar to that shown in the drawings, the sling swivel 168 may be attached or mounted to a forward portion of the stock itself.

An attachment bracket 170 includes a base portion or bipod mounting bracket 172, a generally U-shaped abutment flange 174 and a tongue member 176 protruding therefrom. The tongue member 176 includes a groove or slot 178 therein which is loosely received within an elongated opening 180 in a retaining member 182 in an interference relationship therewith. The retaining member 182 includes a vertically oriented plate portion 184 with a pair of spaced-apart finger members 186 protruding therefrom. The finger members 186 are disposed on opposite sides of the forward portion 166 of the stock mounting bracket 158 and protrude through the interior of the sling swivel 168. The finger members 186 are received or anchored within corresponding slots or apertures 188 in the abutment flange 174 of the attachment bracket 170. A pin 190 prevents the retaining member 182 from slipping off the tongue member 176 when the attachment bracket 170 is not mounted on the rifle 154.

The base portion or bipod mounting bracket 172 of the attachment bracket 170 further includes a resilient leaf-type biasing spring 194 attached to the upper surface thereof. A pair of abutment screws 192 and 196 threadably extend through the base portion or bipod mounting bracket 172 at its rearward and forward ends, respectively. The base portion bipod mounting bracket 172 of the attachment bracket 170 also includes a mounting lug 198 with an aperture 200 extending horizontally or laterally therethrough. Aperture 173 is provided in tongue 175 of a bipod mounting bracket 172 for attachment of a sling or the like.

In order to install the attachment bracket 170 on the rifle 154, the plate portion 184 of the retaining member 182 is loosely pivoted forwardly such that the finger members 186 are removed from the slots or apertures 88 in the abutment flange 174. The finger members 186 are then inserted through the opening in the sling swivel 168 on opposite sides of the forward portion 166 of the stock mounting bracket 158, or on opposite sides of a forward portion of the stock if the firearm is not equipped with a device such as the stock mounting bracket 158. The finger members 186 are then reinserted in the slots or apertures 188 in the abutment flange 174, and the abutment screws 192 and 196 are threadably extended to urge the attachment bracket 170 in a downward direction with respect to the stock 156, thereby causing the finger members 186 to tightly abut the interior of the sling swivel 168 so as to exert a downwardly directed force thereon. Such downwardly directed force acts in a direction opposite the upwardly directed reactive forces exerted by the abutment screws 192 and 196 on the stock 156 and the stock mounting bracket 158, respectively. The combination of such forces creates a mechanical couple which serves to clamp the attachment bracket 170 securely to the rifle 154.

Once the attachment bracket 170 is secured to the rifle 154, the bipod device 10 (not shown) may be attached thereto by means of the fingers or pins 62 of the link members 64 being received within the aperture 200 of the mounting lug 198, as is fully described above in connection with other embodiments of the invention.

It should be noted that a small degree of adjustment of the angle of attachment of the bipod device 10 to the firearm 154 may be obtained by further tightening or extending the abutment screw 192 and thereby increasing the angle between the attachment bracket 170 and the stock 156.

Figure 11:
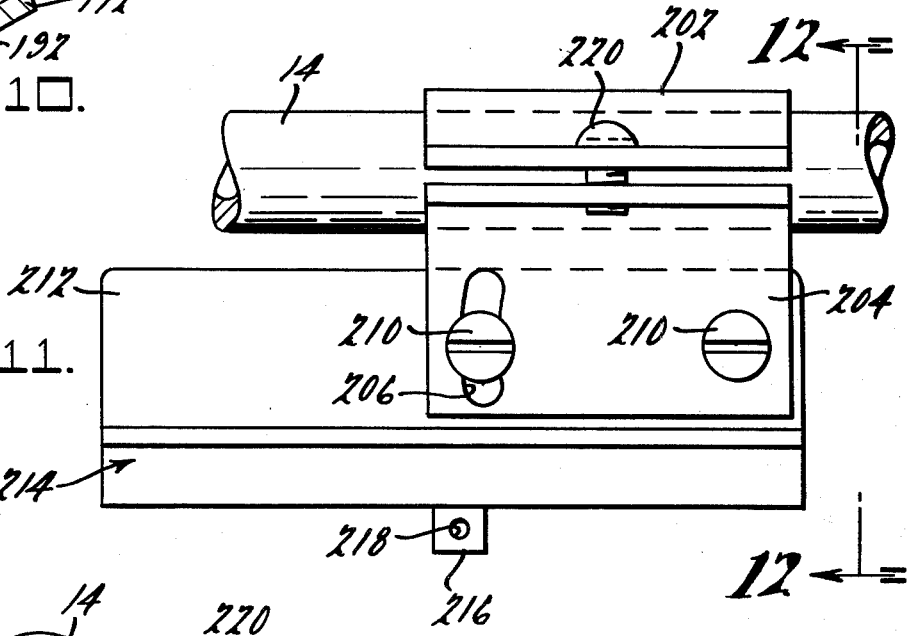
FIG. 11 is a elevation view of a further alternate attachment or mounting apparatus for attaching a bipod device to the barrel of a firearm.
Figure 12:
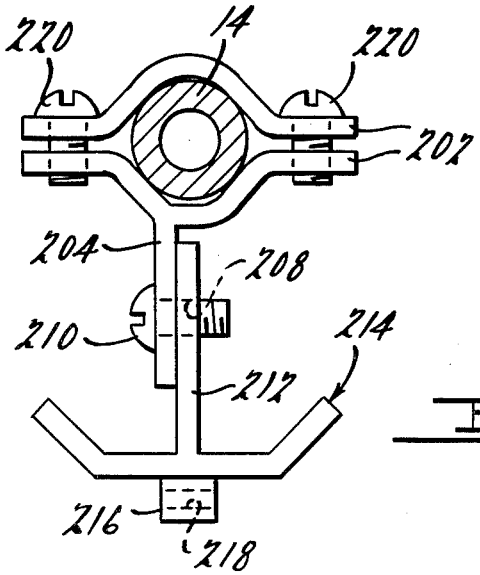
FIG. 12 is a cross-sectional view taken along line 12—12 of FIG. 11.

FIGS. 11 and 12 illustrate still another embodiment of the present invention for mounting the above-described bipod device 10 (not shown) onto the barrel 14 of a firearm. Although the embodiment of FIGS. 11 and 12 is shown in the drawings, for purposes of illustration, with no muzzle brake apparatus included therein, one skilled in the art will readily recognize from the foregoing description of other embodiments of the invention that the embodiment of FIGS. 11 and 12 may be modified to include such muzzle brake apparatus.

A split sleeve portion 202 surrounds and tightly engages the barrel 14 of a rifle in a clamping engagement therewith and includes a mounting flange member 204 downwardly depending therefrom. A pair of apertures 206 and 208 extend horizontally or laterally through the flange member 204 for receiving corresponding fasteners 210 by which the flange member 204 may be secured to the mounting plate 212 of the base portion or bipod mounting bracket 214. Preferably, at least one of the apertures in the flange member 204 is formed in an arcuate or kidney-shaped configuration such that the angle of attachement of the bipod mounting bracket 214 and thus the bipod device 10 may be varied according to the desires of the user.

The bipod mounting bracket 214 includes a mounting lug 216 which protrudes from its lower surface and has an aperture 218 extending horizontally or laterally therethrough.

The bipod device 10 is attached or secured to the bipod or mounting bracket 214 by means of the fingers or pins 62 of the link members 64 of the bipod device 10 as is described fully above in connection with other embodiments of the invention. Since the upper and lower members of the split sleeve portion 202 are secured together by a pair of threaded fasteners 220, the longitudinal location of the bipod device 10 (not shown) may be altered at will by the user merely by loosening the fasteners 220 and sliding the split sleeve portion 202 to the desired location. Furthermore, in the event that the mounting plate 212 interferes with other portions of the rifle, the split sleeve portion 202 may be mounted in an orientation opposite to that shown in FIG. 11, whereby the mounting plate 212 protrudes in a forward rather than a rearward direction.

It can be readily seen by one skilled in the art that the various embodiments depicted in the drawings and described above are well suited to adapt the above-described bipod device of my earlier patent to a wide variety of firearms. Furthermore, in most applications, the advantages of a muzzle brake apparatus may be obtained by employing the preferred embodiments of the inventions as described above.

The foregoing description and accompanying drawings illustrate merely exemplary embodiments of the present invention. Various changes, modifications and variations may be made therein without departing from the spirit and scope of the invention as defined in the following claims.

I claim:

1. An apparatus for securing an auxiliary device to a firearm having a stock assembly thereon and a loop-shaped sling swivel member attached to a foreward portion of said stock assembly, said apparatus comprising a generally horizontal base portion, mounting means for attaching said base portion to said stock assembly, said mounting means including a generally U-shaped vertical abutment flange having legs engaging opposite sides of said forward portion of said stock assembly, a generally horizontal tongue member protruding from the base of said abutment flange and having a slot therein, a generally vertical retaining member in an interference engagement with said slot, said retaining member having a pair of finger members protruding in a generally horizontal direction therefrom, said finger members protruding through the interior of said loop-shaped sling swivel member on opposite sides of said forward portion of said stock assembly, the ends of said finger members being received within apertures in the corresponding legs of said U-shaped abutment flange, and clamping means for urging said finger members into a generally downward-directed forcible engagement with said loop-shaped sling swivel member and for urging said base portion in a generally downward direction relative to said stock assembly such that said clamping means exerts a corresponding upward-directed reactive force against said stock assembly, whereby the combination of said upward-directed relative force and the downward-directed force exerted on said loop-shaped sling swivel by said finger members creates a mechanical couple which clamps the base portion to said stock assembly, said base portion further including a lug member having an aperture extending therethrough for securing the auxiliary device to said firearm.

2. An apparatus according to claim 1, wherein said auxiliary device comprises a bipod device.

3. An apparatus according to claim 1, further comprising angular adjustment means for selectively adjusting the angular relationship between said generally horizontal base portion and said stock assembly, thereby selectively adjusting the angle at which said auxiliary device is secured to said firearm.

4. An apparatus according to claim 1 wherein said generally horizontal tongue member includes means for preventing said retaining member from detachably separating from said generally horizontal tongue member when said apparatus is not secured to said firearm.

5. An apparatus according to claim 1, wherein said generally horizontal base portion includes means for attaching a sling thereto.

6. An apparatus according to claim 5, wherein said generally horizontal base portion has a forward end portion and a rearward end portion, said mounting means being disposed at said forward end portion and said means for attaching a sling being disposed at said rearward end portion.

7. An apparatus according to claim 6 wherein said means for attaching a sling comprises an elongated opening in said rearward end portion.

8. An apparatus according to claim 1, wherein said clamping means includes a pair of threaded elements threadably engaged in apertures in said generally horizontal base portion and a leaf spring having one end secured to an upper surface of said generally horizontal base portion and an opposite free end disposed intermediate said stock assembly and one of said threaded elements.

9. An apparatus according to claim 1, wherein said apparatus further includes angular adjustment means for selectively adjusting the angular relationship between said generally horizontal base portion and said stock assembly, thereby selectively adjusting the angle at which said auxiliary device is secured to said firearm, said generally horizontal tongue member including means for preventing said retaining member from detachably separating from said generally horizontal tongue member when said apparatus is not secured to said firearm, said generally horizontal base portion further having a forward end portion and a rearward end portion, said mounting means being disposed at said forward end portion and said means for attaching a sling being disposed at said rearward end portion, said means for attaching a sling comprising an elongated opening in said rearward end portion, and said clamping means including a pair of threaded elements threadably engaged in apertures in said generally horizontal base portion and a leaf spring having one end secured to an upper surface of said generally horizontal base portion and an opposite free end disposed intermediate said stock assembly and one of said threaded elements.

* * * * *